US009856566B1

(12) United States Patent
Burns et al.

(10) Patent No.: US 9,856,566 B1
(45) Date of Patent: Jan. 2, 2018

(54) METHODS AND APPARATUS FOR MONITORING A SACRIFICIAL ANODE

(71) Applicant: The United States of America as represented by the Secretary of the Air Force, Washington, DC (US)

(72) Inventors: Andrew Michael Burns, Highland Village, TX (US); Matthew James Gutgsell, Jasper, IN (US); Michael David Lee, Orlando, FL (US); Thomas Anthony Lepley, Gambrills, MD (US); Zachary Paul Schrock, Prairie Grove, AR (US); Tony Harrison Zilli, Bellevue, NE (US); Kevin A Gibbons, Colorado Springs, CO (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 247 days.

(21) Appl. No.: 14/810,504

(22) Filed: Jul. 28, 2015

Related U.S. Application Data

(60) Provisional application No. 62/143,355, filed on Apr. 6, 2015.

(51) Int. Cl.

| | |
|---|---|
| ***C23F 13/02*** | (2006.01) |
| ***C23F 13/22*** | (2006.01) |
| ***C23F 13/04*** | (2006.01) |

(52) U.S. Cl.
CPC ..... *C23F 13/22* (2013.01); *C23F 13/04* (2013.01); *C23F 2213/10* (2013.01)

(58) Field of Classification Search
CPC ..... C23F 13/02; C23F 13/04; C23F 13/06; C23F 13/10; C23F 13/18; C23F 13/22; C23F 2213/10
See application file for complete search history.

(56) References Cited

U.S. PATENT DOCUMENTS

| | | | | |
|---|---|---|---|---|
| 4,087,742 | A | 5/1978 | Khoo | |
| 4,306,189 | A | 12/1981 | Nozaki | |
| 5,623,427 | A | 4/1997 | Vandervalk et al. | |
| 5,999,107 | A | 12/1999 | Cooper et al. | |
| 6,932,891 | B2 * | 8/2005 | Wigg | C23F 13/22 204/196.02 |
| 7,402,233 | B1 * | 7/2008 | Morgan | C23F 13/04 204/196.22 |
| 2014/0216945 | A1 * | 8/2014 | Farris | C23F 13/005 205/726 |

* cited by examiner

*Primary Examiner* — Luan V Van
*Assistant Examiner* — Alexander W Keeling
(74) *Attorney, Agent, or Firm* — AFMCLO/JAZ; Jason Sopko

(57) ABSTRACT

A monitored anode apparatus is provided. The apparatus includes a metal body having an exterior and a core, and a plurality of electrically conductive probes passing through the exterior and disposed at respective depths within the core. At least one of the plurality of conductive probes is disposed at a first depth, and at least one of the plurality of conductive probes is disposed at a second depth greater than the first depth. A bonding conductor is in electrical communication with the body and configured to create electrical continuity between the body and a protected structure. The metal body is configured as a galvanic anode, and at least one of the plurality of probes is configured to break electrical conductivity with the body upon galvanic consumption thereof.

13 Claims, 1 Drawing Sheet

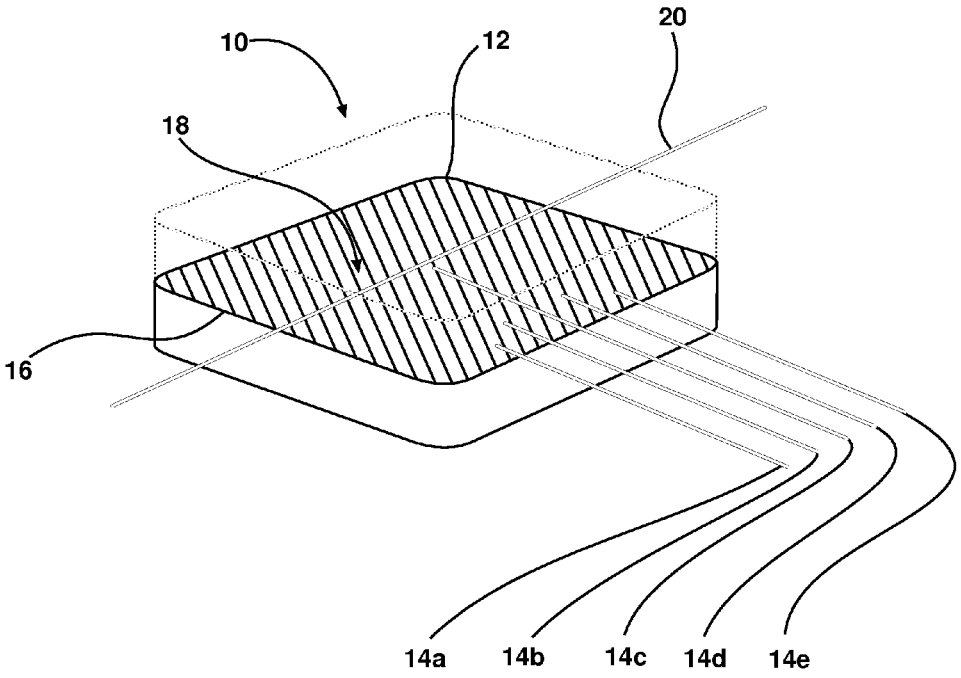
10
12
20
18
16
14a
14b
14c
14d
14e

METHODS AND APPARATUS FOR MONITORING A SACRIFICIAL ANODE

Pursuant to 37 C.F.R. §1.78(a)(4), this application claims the benefit of and priority to prior filed Provisional Application Ser. No. 62/143,355, filed 6 Apr. 2015, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to cathodic protection of metallic structures, and more specifically to non-destructive monitoring of imbedded sacrificial anodes.

BACKGROUND OF THE INVENTION

Many metallic structures, such as buried pipelines and steel reinforced concrete bridges, are protected from corrosion by cathodic protection. One form of cathodic protection employs sacrificial anodes. For such systems, remaining anode life equates to remaining structural corrosion via cathodic protection, since the sacrificial anode is consumed while protecting a metallic structure. Once a sacrificial anode becomes completely depleted, it must be replaced, so that the rebar or other metal that it protects does not corrode.

The remaining life of an embedded anode is currently difficult to assess in many situations. For example, the anode may not be visible for inspection when it is embedded in concrete (such as bridge construction), or when buried under soil to protects below grade metallic structures. Analysis of anodes subsumed by concrete necessitates removal of large portions of the structure, and similarly, unearthing buried anodes is not a trivial matter.

Even exposed anodes may pose inspection problems. For example, though anodes on ship hulls are generally exposed, inspection necessitates the use of divers or surveillance while in a dry-dock condition. Additionally, even if the anode is surface mounted, the protected asset may be remotely located in a difficult to access, or dangerous environment.

As there are no presently non-destructive methods of inspecting concealed anodes, and since some surface mounted remote anodes still pose surveillance challenges, there exists a need in the art for non-destructive and remote monitoring of cathodic protection sacrificial anodes. Additionally, there exists a need in the art for methods and apparatus to track anode life and to predict when the anode will be depleted.

SUMMARY OF THE INVENTION

The present invention overcomes the foregoing problems and other shortcomings, drawbacks, and challenges of monitoring anodes. While the invention will be described in connection with certain embodiments, it will be understood that the invention is not limited to these embodiments. To the contrary, this invention includes all alternatives, modifications, and equivalents as may be included within the spirit and scope of the present invention.

According to one embodiment of the present invention, a monitored anode apparatus is provided. The apparatus includes a metal body having an exterior and a core, and a plurality of electrically conductive probes passing through the exterior and disposed at respective depths within the core. At least one of the plurality of conductive probes is disposed at a first depth, and at least one of the plurality of conductive probes is disposed at a second depth greater than the first depth. A bonding conductor is in electrical communication with the body and configured to create electrical continuity between the body and a protected structure. The metal body is configured as a galvanic anode, and at least one of the plurality of probes is configured to break electrical conductivity with the body upon galvanic consumption thereof.

According to another embodiment of the disclosed invention, a method for monitoring a sacrificial anode having a metal body including an exterior and a core, a plurality of electrically conductive probes passing through the exterior and disposed at respective depths within the core, wherein at least one of the plurality of conductive probes is disposed at a first depth, and wherein at least one of the plurality of conductive probes is disposed at a second depth greater than the first depth, is provided. The method includes taking an electrical continuity measurement between the probe disposed at the first depth and the second depth. The method further includes determining that the body of the sacrificial anode has been consumed to a depth of at least the second depth if electrical continuity is absent, and determining that the body of the sacrificial anode has not been consumed to a depth of at least the second depth if electrical continuity is present.

Additional objects, advantages, and novel features of the invention will be set forth in part in the description which follows, and in part will become apparent to those skilled in the art upon examination of the following or may be leaned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

FIG. 1 is a cross sectional view illustrating a sacrificial anode including embodiments of the disclosed invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Turning attention to FIG. 1, a monitored anode 10 includes a sacrificial body 12 and a plurality of conductive probes 14*a*-14*e* embedded therein. The body 12 may be comprised of any galvanic metal, to include magnesium, aluminum, zinc, and the like, suitable for use with cathodic protection systems. In some embodiments of the disclosed invention, the body 12 is cast in place around the probes 14*a*-14*e*, and in other embodiments, the probes 14*a*-14*e* are inserted in bores disposed within the body 12.

During use in a cathodic protection system, the body 12 of the monitored anode 10 is consumed through galvanic action. The body 12 is therefore sacrificed in lieu of a structure it is configured to protect. During this consumption process, the body 12 is consumed starting at the exterior 16 of the body 12 and progressing into the core 18 of the body 12.

To monitor the consumption of the body 12, the probes 14*a*-14*e* may be disposed at a plurality of depths to accomplish design and monitoring objectives. In some embodiments, the plurality of probes 14*a*-14*e* are emplaced within the core 18 of the body 12 in a staggered configuration as shown in FIG. 1. The probes 14*a*-14*e* are electrically coupled to the body 12 (by way of a pressed-in interference fit, casting in place, soldering, welding, etc.), and extend therefrom. As shown, probe 14*c* is emplaced at the greatest depth, probes 14*b* and 14*d* are emplaced at a more shallow depth, and probes 14*a* and 14*e* are emplaced at the most shallow depth.)

In this configuration, when the monitored anode 10 is placed into service, electrical continuity exists between each of probes 14*a* through 14*e*. As the monitored anode 10 is consumed by galvanic corrosion, the exterior 16 recedes inwardly toward the core 18, and the body 12 eventually breaks electrical continuity from probes 14*a* and 14*e* (this assumes symmetric consumption of the monitored anode and emplacement of probes 14*a* and 14*e* at identical depths). If the anode is being consumed symmetrically, and the depths of each of the various probes 14*a*-14*e* are known, then the remaining volume and mass of the monitored anode 10, and thus remaining service life, may be calculated.

If asymmetric consumption of the monitored anode 10 occurs, this asymmetry may be detected by observing a break in electrical continuity between, for example, probe 14c and 14a prior to a break in continuity between probe 14*c* and 14*e*. Likewise, the rate of consumption may be ascertained by plotting the various times at which continuity is lost between various pair of probes 14*a*-14*e*. By way of further example, probe 14*c* may be referred to as being disposed along an axis of the body 12, while probe 14*a* is disposed on a first side of the axis, and wherein probe 14*e* is disposed symmetrically from probe 14*a* on another side of the axis.

The continuity between probes 14*a*-14*e* may be tested by automated or remote means known to one of ordinary skill in the art. For example, a processor may perform a weekly test on the monitored anode 10, and thereafter transmit test results via wired connection, RF, optical, or other medium to a remote location. Conversely, a user may periodically interface with a test station near the monitored anode 10 to perform monitoring. In some embodiments, insulated conductors connect the probes 14*a*-14*e* to terminals at the remote test station. For example, for monitored anodes 10 emplaced in reinforced concrete structures, a cable having insulated conductors mated to the probes 14*a*-14*e*, may exit the concrete structure and terminate at the test station to enable non-destructive testing of the monitored anode 10 (there is no need to disturb the cured concrete).

By testing at discrete intervals, and by establishing the time and date between breaks in continuity of probes, remaining service life, optimal inspection interval, scheduling of anode replacement, and the design of future anode configurations and compositions may be ascertained far in advance of actual failure of the monitored anode 10. Therefore each of inaccessible anodes (emplaced in concrete or earth), difficult to access anodes (below water or placed in hostile environments), and surface mounted anodes may be monitored and modeled with enhanced precision.

Some embodiments of the invention include a bonding conductor 20 to establish electrical continuity between the monitored anode 10 to the structure to be protected (rebar, pipeline, ship hull, and the like). In some embodiments of the disclosed invention, the bonding conductor 20 may be used as a probe (in conjunction with other cooperating probes) for testing consumption of the monitored anode 10, while other embodiments dedicate the bonding wire 20 only for interconnection between the monitored anode 10 and the protected structure.

It is noted that embodiments of the invention contemplate emplacement of probes from a plurality of sides, angles, and orientations with respect to the monitored anode 10. Moreover, the number of probes may be adjusted to yield varying degrees of resolution (many probes disposed at small variations in depth), for redundancy, or for detecting asymmetric consumption of the anode with respect to all three dimensional planes. The probes 14*a*-14*e* may be insulated exterior to the body 12 so that test measurements are not influenced by probes 14*a*-14*e* contacting external objects.

Embodiments of the disclosed invention also provide an accurate measurement of total remaining sacrificial anode mass while accounting for self-corrosion of the sacrificial anode. The noted self-corrosion is tantamount to a short circuit wherein the sacrificial anode will experience an unavoidable amount of localized oxidation or reduction reactions occurring at or near the anode's surface. When this reaction occurs, the anode mass is consumed, thus producing resulting ions and electrons. However, the electrons don't flow through the electrical circuit to the steel structure that is intended to be protected. These electrons are essentially "wasted," and they simply react and are consumed at the cathodic sites near or on the anode surface. As a result, the electron transfer is not useful in protection of the steel. Though methods exist to monitor an anode by measuring current flowing in the protection circuit and integrating over time to deduce the anode mass consumption correlative of that current, such methods cannot account for self-corrosion. Conversely, embodiments of the disclosed invention do accurately account for self-corrosion by measuring the total remaining sacrificial anode mass as an absolute quantity.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A monitored anode apparatus, the apparatus comprising;

a metal body having an exterior and a core;

a plurality of electrically conductive probes passing through the exterior and disposed at respective depths within the core, the plurality of electrically conductive probes each having a probe end and a terminating end, wherein a probe end of at least one of the plurality of conductive probes is disposed at a first depth, wherein a probe end of at least one of the plurality of conductive probes is disposed at a second depth greater than the first depth, and wherein terminating ends of the electrically conductive probes disposed at the first depth and the second depth are disposed outside the core of the metal body;

a bonding conductor in electrical communication with the body and configured to create electrical continuity between the body and a protected structure; and wherein the metal body is configured as a galvanic anode, and wherein at least one of the plurality of electrically conductive probes is configured to break electrical conductivity with the body upon galvanic consumption thereof.

2. The anode of claim 1, wherein some of the plurality of electrically conductive probes are disposed symmetrically with respect to an axis of the body, and wherein the electrically conductive probes are configured to detect asymmetric galvanic consumption of the body.

3. The apparatus of claim 1, wherein at least one of the plurality of electrically conductive probes is disposed non-coplanar with another of the plurality of probes.

4. The apparatus of claiml, wherein at least one of the plurality of electrically conductive probes passes through the exterior on a side of the body distinct from another side of the body through which another of the plurality of probes passes.

5. A method for monitoring a sacrificial anode having a metal body including an exterior and a core, a plurality of electrically conductive probes passing through the exterior and disposed at respective depths within the core, each of the plurality of conductive probes having a probe end and a terminating end, wherein at least one of the plurality of conductive probes is disposed at a first depth, and wherein at least one of the plurality of conductive probes is disposed at a second depth greater than the first depth, the method comprising:

taking an electrical continuity measurement between a probe end of a probe of the plurality of conductive probes disposed at the first depth within the core and a probe end of a probe of the plurality of conductive probes disposed at the second depth within the core, the terminating ends of the probes disposed outside the core; and determining that the body of the sacrificial anode has been consumed to a depth of at least the second depth if electrical continuity is absent, and determining that the body of the sacrificial anode has not been consumed to a depth of at least the second depth if electrical continuity is present.

6. The method of claim 5, wherein additional depths of consumption are determined by measuring electrical continuity of additional probes disposed at depths greater than the second depth.

7. The method of claim 5, wherein some of the plurality of probes are disposed symmetrically about an axis of the body, and wherein asymmetric consumption of the body is determined by testing and observing absence of electrical continuity of probes disposed on one side of the axis prior to observing an absence of electrical continuity of probes disposed on another side of the axis.

8. The method of claim 5, wherein a processor is in electrical communication with the plurality of probes, and the taking of electrical continuity measurements is performed by the processor.

9. The method of claim 8, wherein the processor performs the electrical continuity measurements according to a schedule.

10. The method of claim 8, wherein the processor transmits the results of the electrical continuity measurements to a remote location.

11. The method of claim 8, wherein remaining anode life is determined by measuring the time between broken continuity of a first pair of probes, and a second pair of probes disposed at a depth greater than the first set of probes.

12. The method of claim 5, further comprising prior to taking the electrical continuity measurement:

passing the probe ends of the plurality of electrically conductive probes through the exterior of the sacrificial node; and disposing the probe end of the first probe at the first depth within the core and disposing the probe end of the second probe at the second depth within the core, the terminating ends of the first and second probes disposed outside the core.

13. The apparatus of claim 1, the bonding conductor having a bonding probe end and a bonding terminating end in cooperate arrangement to establish electrical continuity between the body and the protected structure, wherein the bonding probe end is configured to be used as an auxiliary conductive probe.

* * * * *